US005937667A

United States Patent [19]

Yoho, Sr.

[11] Patent Number: 5,937,667

[45] Date of Patent: Aug. 17, 1999

[54] SYSTEM FOR THE DEHUMIDIFICATION OF COOLED AIR

[75] Inventor: Robert W. Yoho, Sr., Clearwater, Fla.

[73] Assignee: Advanced Thermal Technologies, LLC, Little Rock, Ark.

[21] Appl. No.: 08/840,032

[22] Filed: Apr. 24, 1997

[51] Int. Cl.[6] ..... F25D 17/06

[52] U.S. Cl. ..... 62/271; 96/125

[58] Field of Search ..... 62/94, 271; 96/125

[56] References Cited

U.S. PATENT DOCUMENTS

| | | | |
|---|---|---|---|
| 2,200,243 | 5/1940 | Newton et al. | 62/271 |
| 3,398,510 | 8/1968 | Pennington | 96/125 |
| 4,180,985 | 1/1980 | Northrup, Jr. | 62/271 |
| 4,669,274 | 6/1987 | Huang | 62/342 |
| 5,353,606 | 10/1994 | Yoho et al. | 62/271 |
| 5,423,187 | 6/1995 | Fournier | 62/271 |
| 5,584,916 | 12/1996 | Yamashita et al. | 96/125 |

*Primary Examiner*—William E. Tapolcai

*Attorney, Agent, or Firm*—Joseph C. Mason, Jr.; Dennis G. LaPointe

[57] ABSTRACT

Conduits or chambers for use in directing and conditioning the flows of air or fluids using a wide variety of heat generation, cooling, variation of pressure or vacuum and the effect of this on a member that is moved or rotated from one chamber to other chambers to effect the removal of moisture, particles and some gasses from an air or fluid stream that is conditioned for a specified use; generally, but not limited to a living or storage environment.

6 Claims, 13 Drawing Sheets

SYSTEM FOR THE DEHUMIDIFICATION OF COOLED AIR

BACKGROUND OF THE INVENTION

1. Field of the Invention

The present invention relates to a cooling assembly and more particularly pertains to drying of air using a drum with desiccant rotating between air paths with a cooling assembly.

2. Description of the Prior Art

The use of air conditioners is known in the prior art. More specifically, air conditioners heretofore devised and utilized for the purpose of processing cooled air are known to consist basically of familiar, expected and obvious structural configurations, notwithstanding the myriad of designs encompassed by the crowded prior art which have been developed for the fulfillment of countless objectives and requirements.

In this respect, the cooling assembly according to the present invention substantially departs from the conventional concepts and designs of the prior art, and in doing so provides an apparatus primarily developed for the purpose of drying of air using a drum with desiccant rotating between air paths.

Therefore, it can be appreciated that there exists a continuing need for new and improved cooling assembly which can be used for drying of air using a drum with desiccant rotating between air paths. In this regard, the present invention substantially fulfills this need.

Therefore, it is an object of the present invention to provide an improvement which overcomes the aforementioned inadequacies of the prior art devices and provides an improvement which is a significant contribution to the advancement of the art.

Another object of the present invention is to convey process air through a drying section where moisture, particles and unwanted gasses are absorbed or adsorbed based on the materials used in the composition of the exchanger or wheel. Although a wheel processor is picked for clarity this patent is not limited to the use of a wheel, it could be a toaster, here a holder containing desiccant material is moved between two paths, one for dehumidification of processed air (absorption of moisture) the other for the processing or drying of this air (Desorption of moisture).

Desiccants and Desiccant Dehumidification, desiccant materials have a great affinity for water vapor, and typically their moisture content is a function of the relative humidity of the surrounding air. When exposed to low relative humilities desiccant materials come to equilibrium at low moisture contents also when exposed to high relative humilities there results an equilibrium at high moisture contents. Actually all materials exhibit desiccant type behavior but the term desiccant is reserved for materials for which this behavior can be exploited to produce some predictable and useful result.

A desiccant dehumidifier is a device that uses a desiccant material to produce a dehumidification effect. The process consists in the exposure of the desiccant material to a high relative humidity air stream, allowing it to attract and retain some of the water vapor and then exposing the same desiccants to a lower relative humidity air stream which has the effect of drawing the retained moisture from the desiccant. The first air stream is the air that is being dehumidified while the second stream is used to regenerate the desiccant material (renew) so that it can be recycled for another time. It should be observed that the first air streams water vapor content is reduced while the second air stream's water vapor is increased. Generally the lower relative humidity air stream is air taken from a source, being processed, and heated to reduce its relative humidity. As can be seen desiccant dryers normally consume heat energy to produce their drying or dehumidifying effect.

Desiccant dehumidification is accomplished through the use of four major components. The item that holds the desiccant(s) of which there are several major types, a fan to move the process air to be dehumidified through the holder, a fan also to move the processed low humidity air being regenerated again through the desiccant holder and a heater to heat the regeneration air that is used to dry the desiccant. The above describes the use of one of several techniques used in dehumidification called cyclical or toaster type of operation. In this case the desiccant is in a container through which the air is passed first into the process stream allowing it to reach saturation, then it is cycled into the low humidity stream, heated air, and processed until it is dry or regenerated. Generally there are sets of two or more of these containers that are alternated between streams. This process with one set of containers produce a varying process since the adsorption and Desorption rates vary as the desiccant reaches saturation. A non-cyclical method of desiccant dehumidification is produced when the desiccant is contained in a rotating holder or wheel. Both air streams pass through the wheel accomplishing processing and regeneration at the same time in separate sections of the desiccant holders or wheel. The wheel rotates very slowly based on the thickness of the wheel and relative temperature difference between the air streams.

In actual practice these air streams must not be allowed to commingle with each other. Ducting and careful insulation of the separate chambers accomplishes this. Naturally since one side of the wheel, the regeneration or dehumidifying side is heated some heat is transferred to the processing side raising the ambient temperature of air being dehumidified, this is also addressed in this patent.

Another less technical way to describe this process is that after the absorber is effectively saturated based on data or art, it is then relocated to an adjacent chamber that removes the absorbed, adsorbed or trapped particles, the process removes these undesired items through the use of temperature differential, change in pressures or volume of air in the exchange area, a counter flow also removes any large trapped particles.

Another object of the present invention is to optimize the heat transfer capabilities in air conditioners and other devices of the type which normally employ heat exchangers.

A further object of the present invention is to transfer moisture and particles and gasses from air in one path to another path.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of Summarizing this invention, this invention is comprised of conduits or chambers for use in directing and conditioning the flows of air or fluids using a wide variety of heat generation, cooling, variation of pressure or vacuum and the effect of this on a member that is moved or rotated from one chamber to other chambers to effect the removal of moisture, particles and some gasses from an air or fluid stream that is conditioned for a specified use; generally, but not limited to a living or storage environment.

These concepts that are of a two temperature or a path nature could have other applications such as the removal of metals from a liquid path through the rotating drum if the drum is made of a metal grid which is energized to one voltage in one duct and the metal(s) are deposited and through further voltaic processing removed in the other chamber.

The present invention is comprised of a first air path for drying air. The first path has an opening with a filter disposed therein. A desiccant wheel is rotatably disposed between the first path and a regenerating path. A return duct to a residence requiring dehumidified air is provided for dispensing the conditioned air. A second air path for regenerating air and driving moisture from the desiccant wheel is next provided. A filter is disposed inwardly thereof. Hot water coils are disposed inwardly of the filter for starting the dry cycle. A duct is provided for allowing cooler air to be sucked from the first air path into the second air path. Moist air is evacuated through a blower and exits through the second air path.

The foregoing has outlined rather broadly the more pertinent and important features of the present invention in order that the detailed description of the invention that follows may be better understood so that the present contribution to the art can be more fully appreciated. Additionally features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention in not only a gas (air) but also a liquid environment. It should also be realized by those skilled in the art that such equivalent constructions do not depart from the spirit and scope of the invention as set forth in the appended claims.

In the view of the foregoing disadvantages inherent in the known types of air conditioners now present in the prior art, the present invention provides an improved cooling assembly. As such, the general purpose of the present invention, which will be described subsequently in greater detail, is to provide a new and improved cooling assembly and method which has all the advantages of the prior art and none of the disadvantages.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The quick release features again allows quick removal of the drum. The drum can be firmly mounted through an idler.

Figure 7:
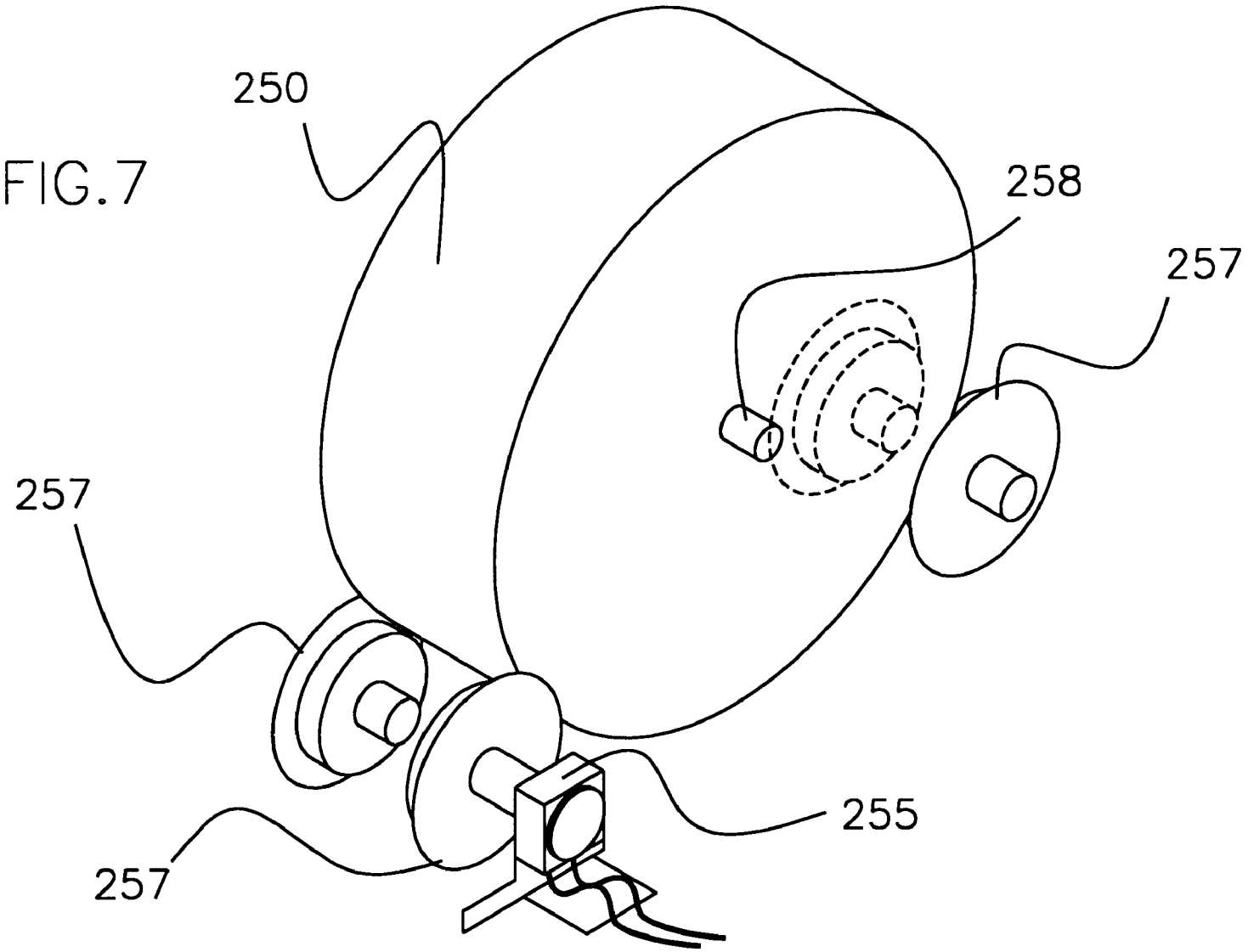

FIG. 7 this is an alternative of the drum drive, the wheels shown as rollers could also be flanged to guide the desiccant wheel.

DESCRIPTION OF THE PREFERRED EMBODIMENT

Environment

Figure 1:
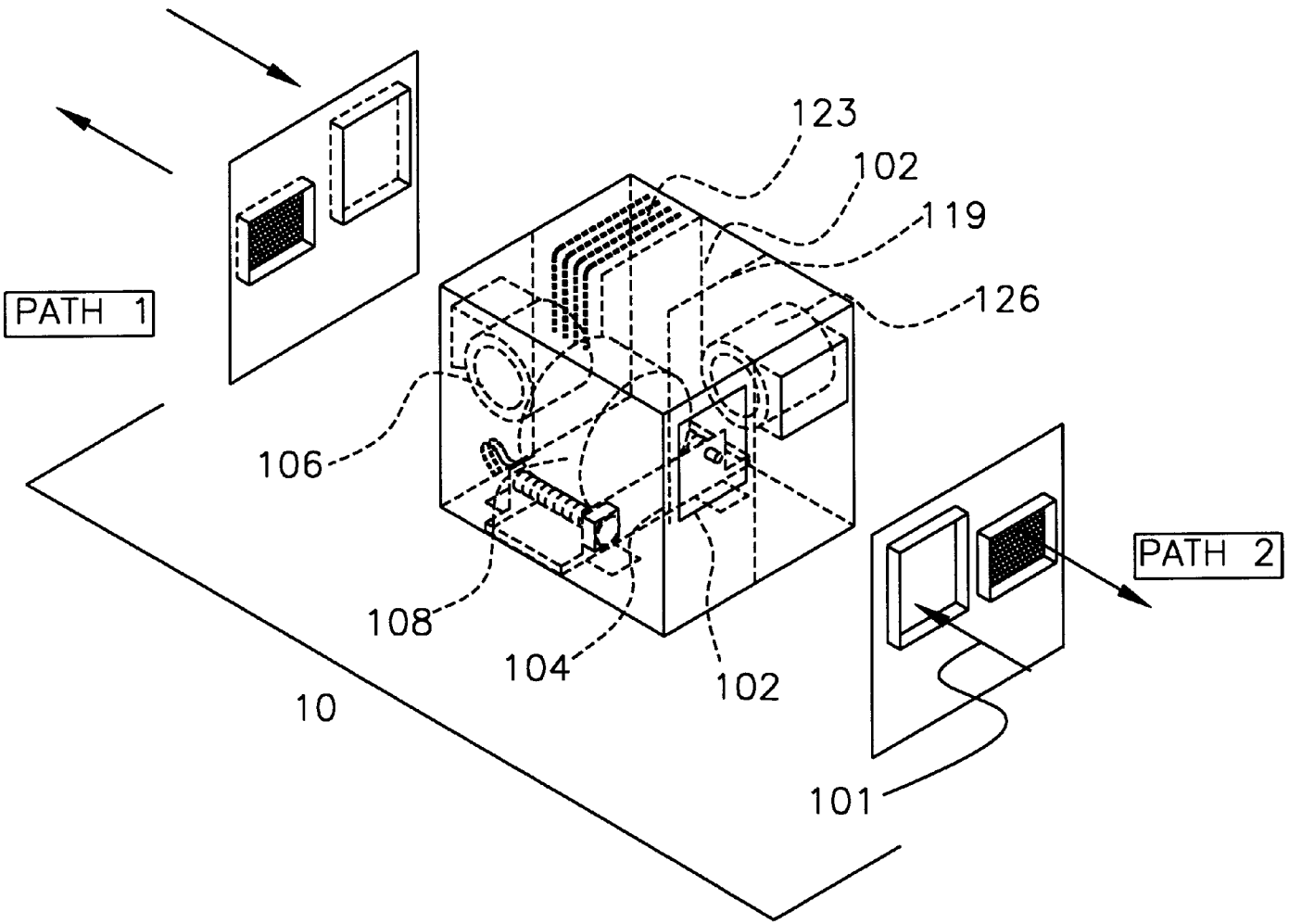
FIG. 1 is a cooling assembly with a desiccant wheel and various heat exchangers some included for the first time in such a concept.

FIG. 1 is a pictorial of a cooling assembly with a desiccant wheel, heat exchangers, heaters and induction heat booster with relevant accessories.

Figure 1A:
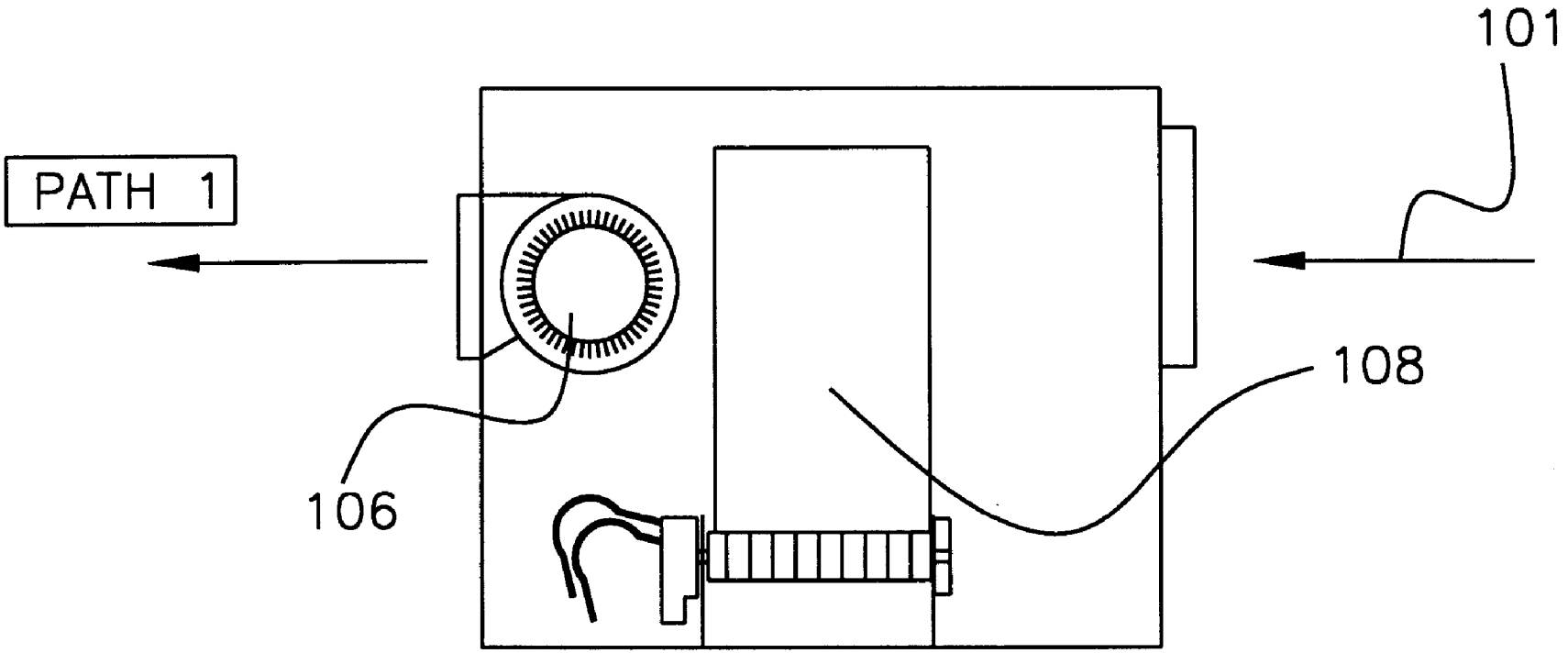
FIG. 1*a* is a side view of the first path.
Figure 1B:
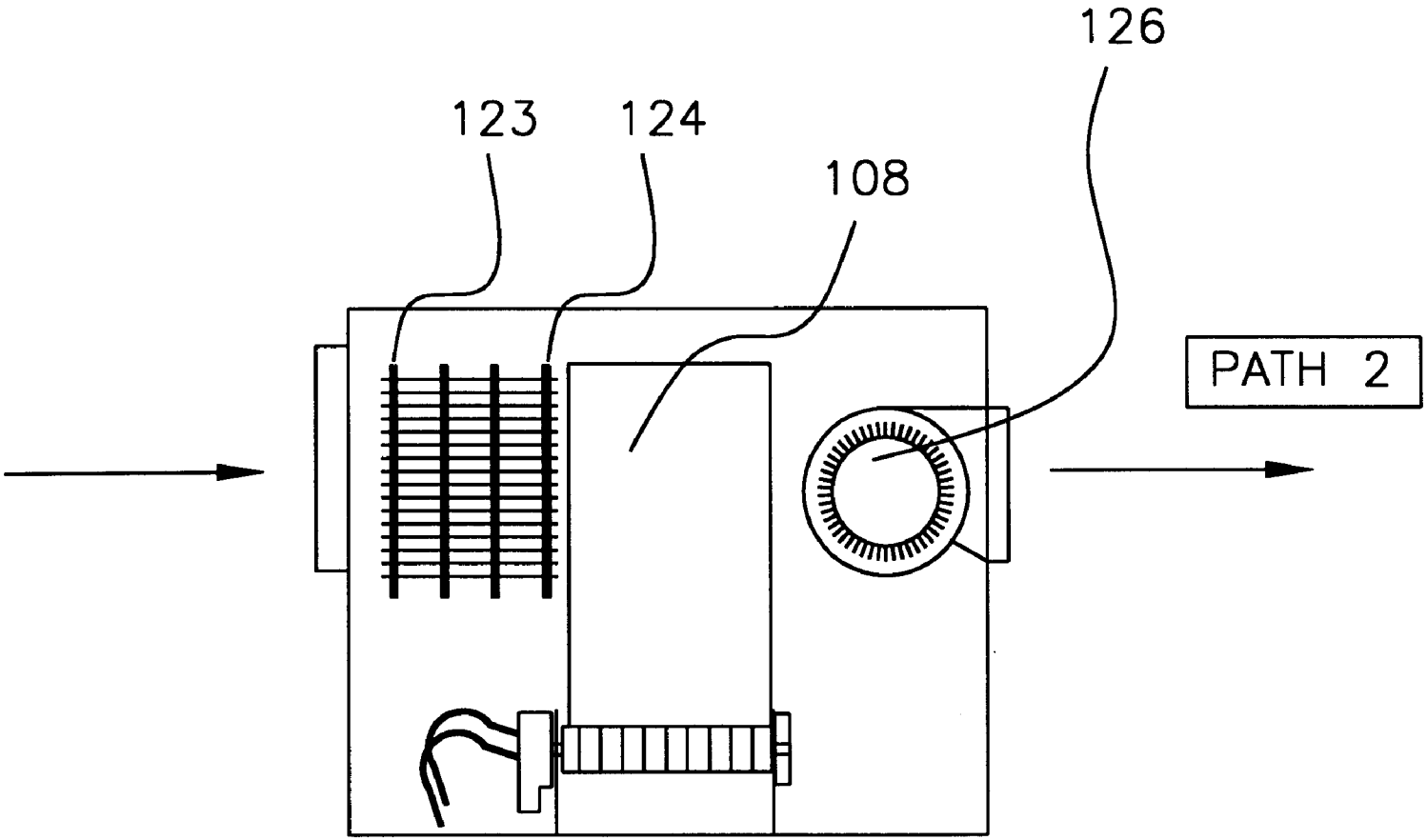
FIG. 1*b* is a side view of the second path.

FIG 1*a* and 1*b* are detail of paths, induction coil and drive module. Here the paths are shown and the wheel cooling section is defined.

Figure 2:
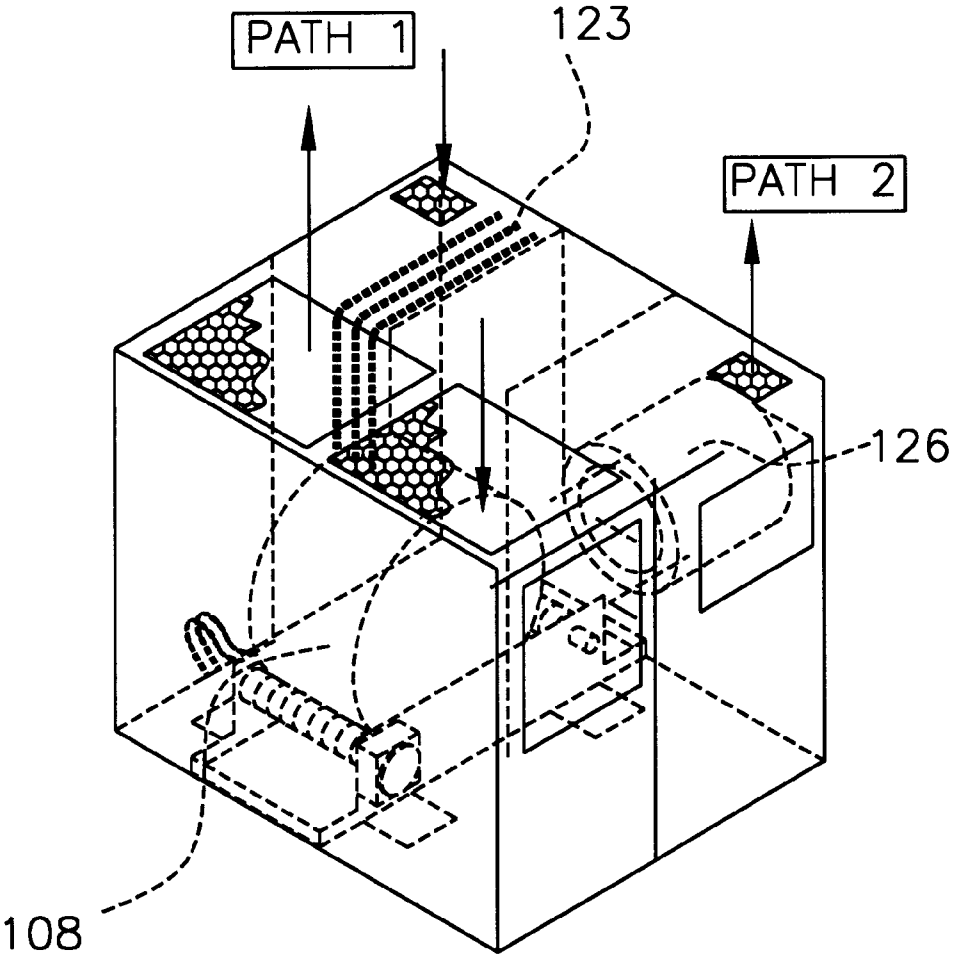
FIG. 2 is a perspective illustration of a cooling unit with a desiccant wheel and conventional heat exchangers with upward flow.

FIG. 2 is a perspective illustration of a cooling unit with a desiccant wheel and heat exchangers.

Figure 2A:
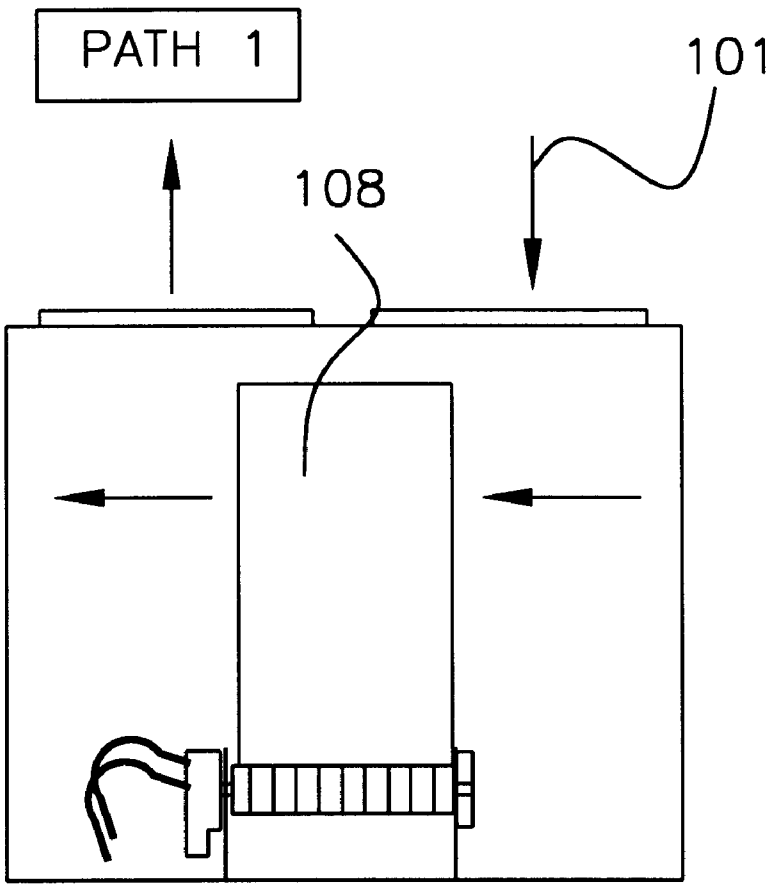
FIG. 2*a* is a side view of the illustration of the first path shown in FIG. 2.

FIG. 2*a* is a side view of the illustration of the first path shown in FIG. 2.

Figure 2B:
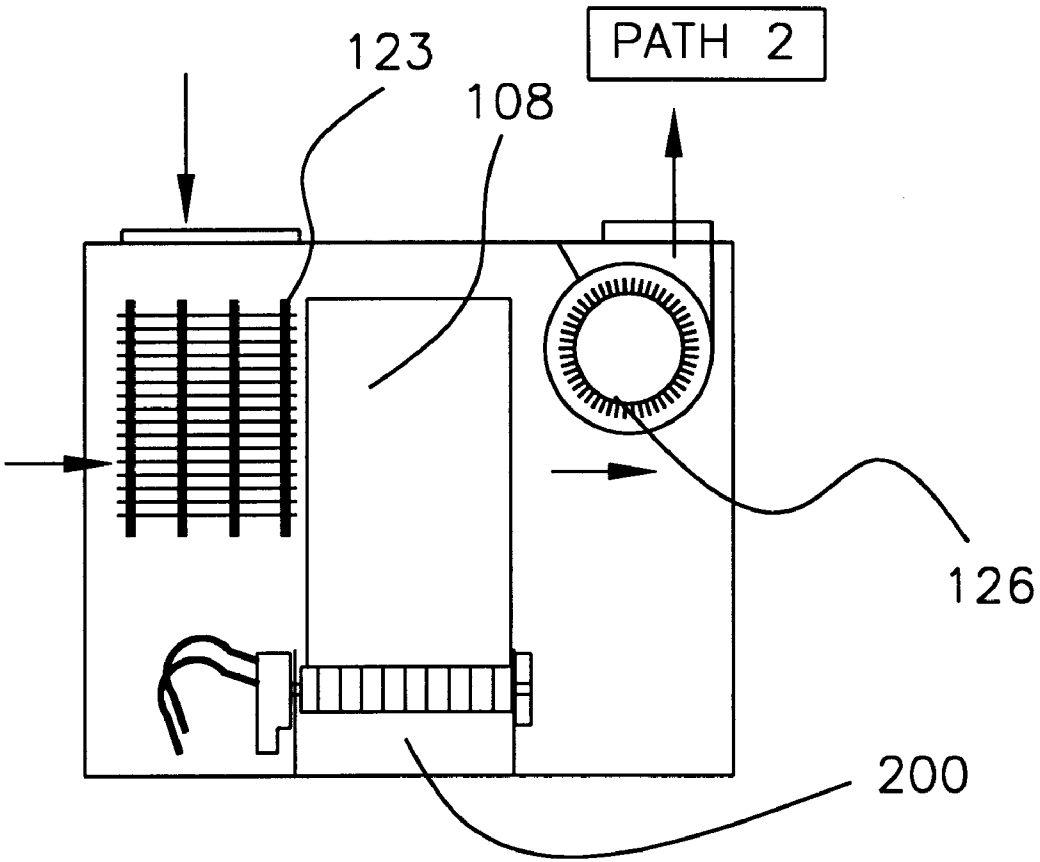
FIG. 2*b* is a side view of the illustration of the second path shown in FIG. 2.

FIG. 2*b* is a side view of the illustration of the second path shown in FIG. 2.

Figure 3:
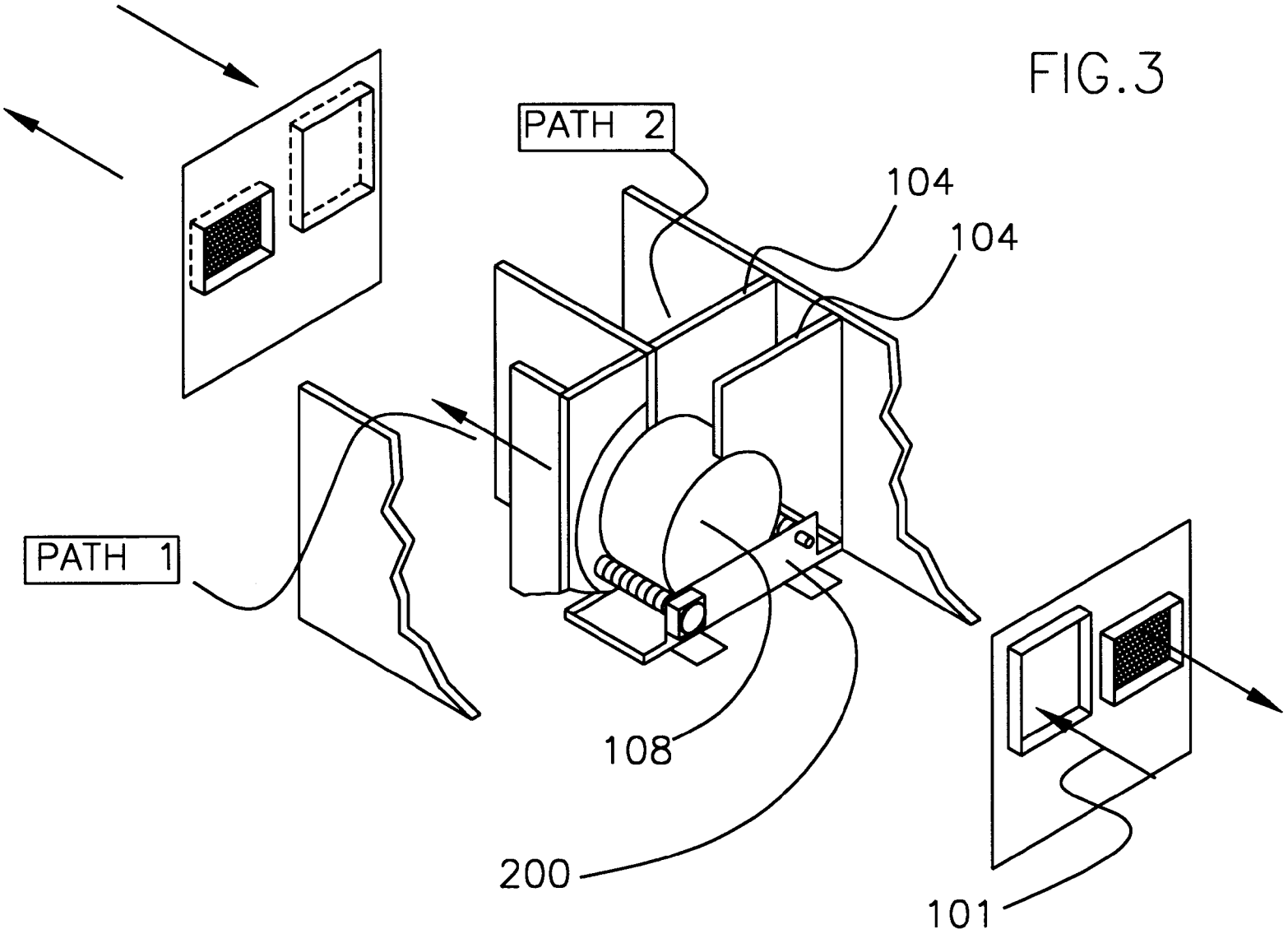
FIG. 3 and FIG. 3*a* illustrate a perspective view of a unit similar to above. This shows the arrangement of major components placed in the unit. The object here is to allow one larger design fit various air (tonnage) capacities. Blowers have been omitted for clarity. This is accomplished by allowing the excess air for larger units to bypass the wheel at the absorption or adsorption side.
Figure 3A:
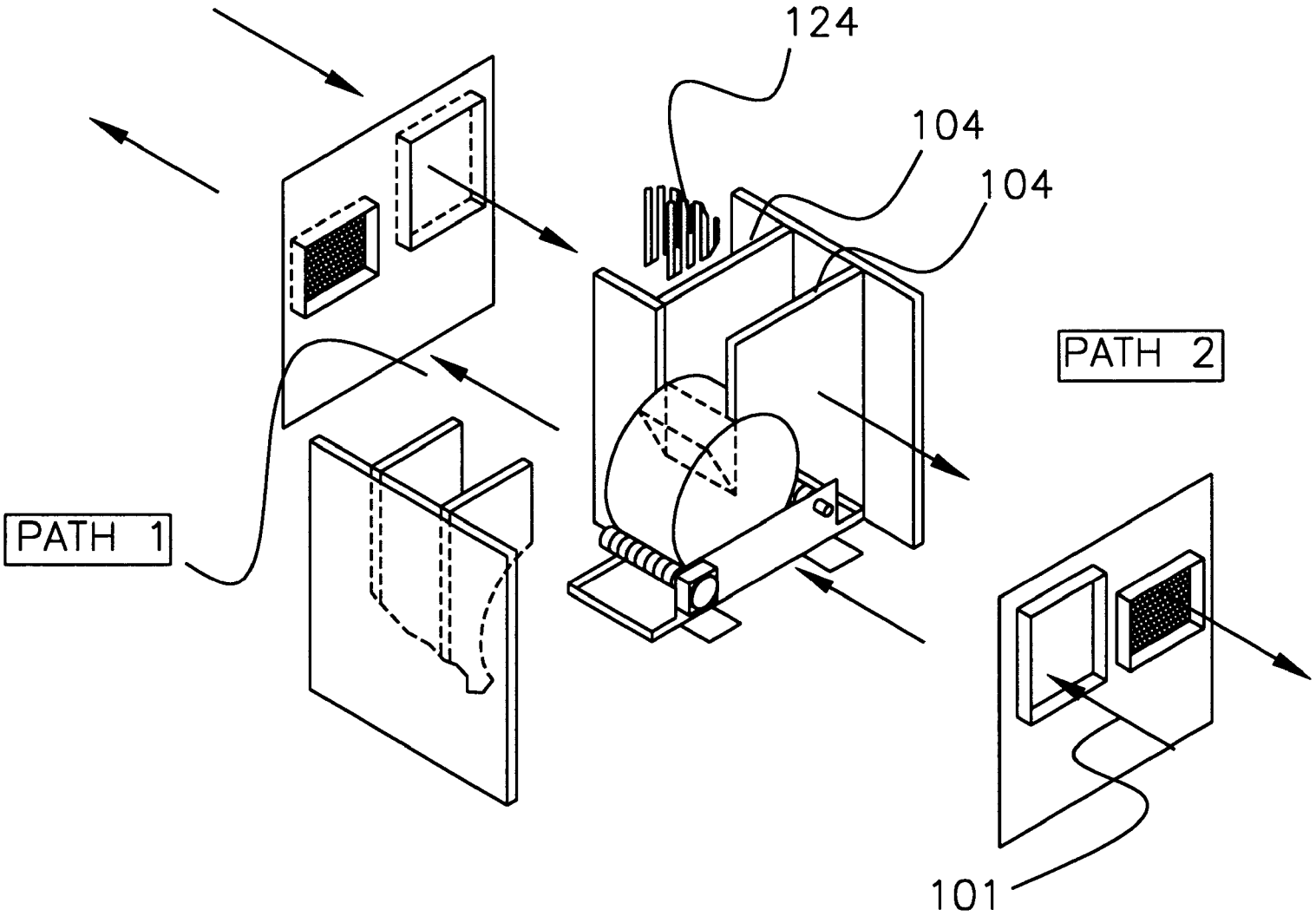

FIG. 3 and FIG. 3*b* illustrate a perspective view of the unit above. This shows the arrangement of major components placed in the unit. The object here is to allow one larger design fit various air (tonnage) capacities. Blowers are omitted for clarity. This is accomplished by allowing the excess air for larger units to bypass the wheel at the absorption or adsorption side. The measured process air velocity in this application varies greatly at the wheel face when compared to the bypass velocity. This method of exposing one side of the wheel or toaster in the air path, or the duct that might have varying flows is unique.

Figure 4:
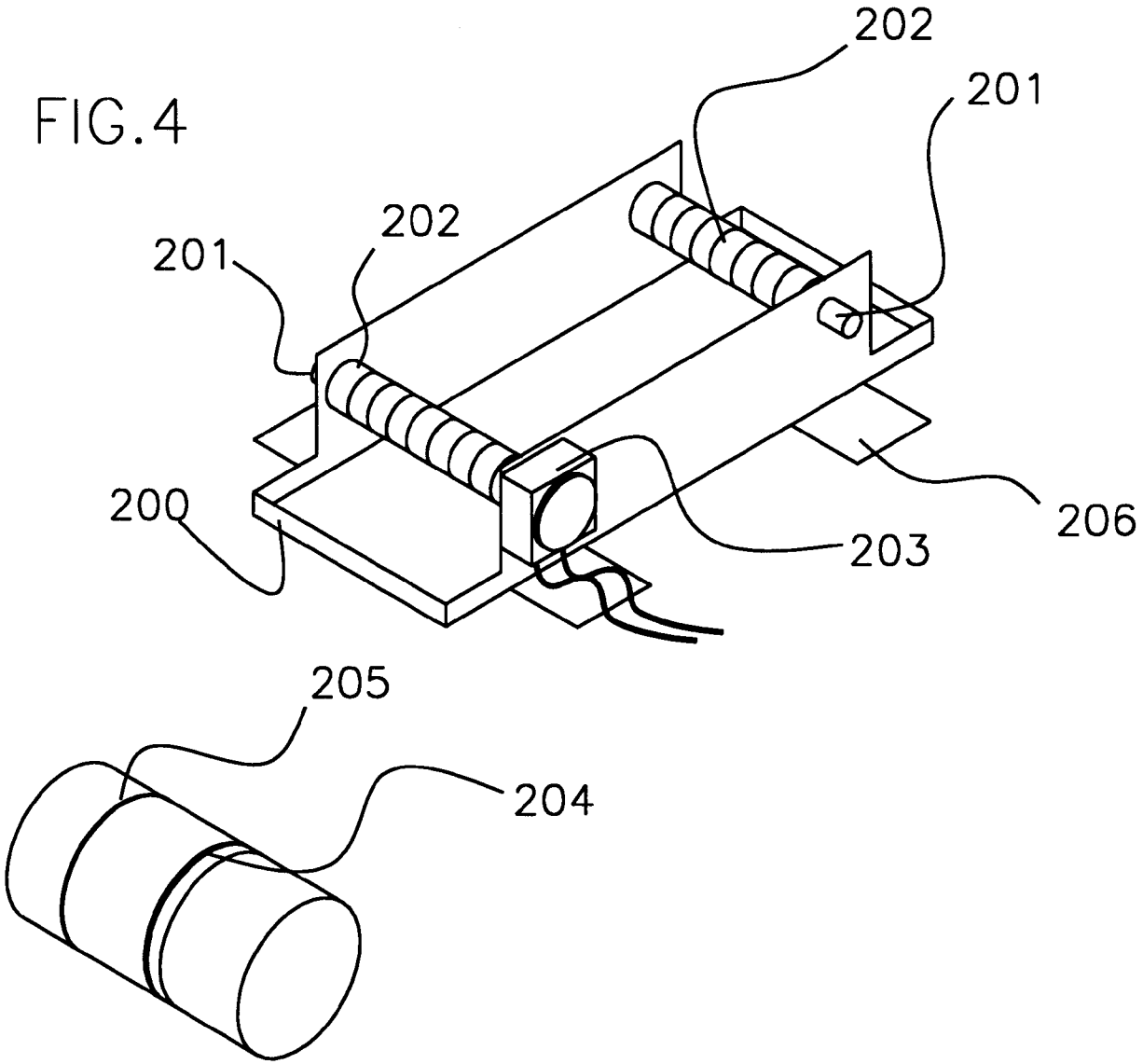
FIG. 4 is the roller drive for the desiccant wheel or drum. Most desiccant wheels are driven with a belt see FIG. 7. This unique feature allows the drum to be driven in a fashion for easy removal and eliminates the problem of easy storage, replacement, reversal for desiccant distribution, since some desiccants migrate with the air flow, also of worn belts and the need to have a service person remove the wheel and the extra time to remove it. This feature also removes the stress of a tensioned system. This system with the aid of an upper tensioned roller for transit applications, this means of support is excellent.

FIG. 4 represents a convenient method of driving the desiccant wheel. It is a specialty integrated drive wheel using o-rings or a coating to increase friction. The motor bracket locks into our specially designed pan and bulkhead assembly. This design further allows the alignment and truing of the desiccant wheel and its instantaneous removal to allow reversal for chemical re-deposition and rejuvenation or storage and replacement. The matching idler uses the squared bulkhead assembly as a mounting.

Figure 5:
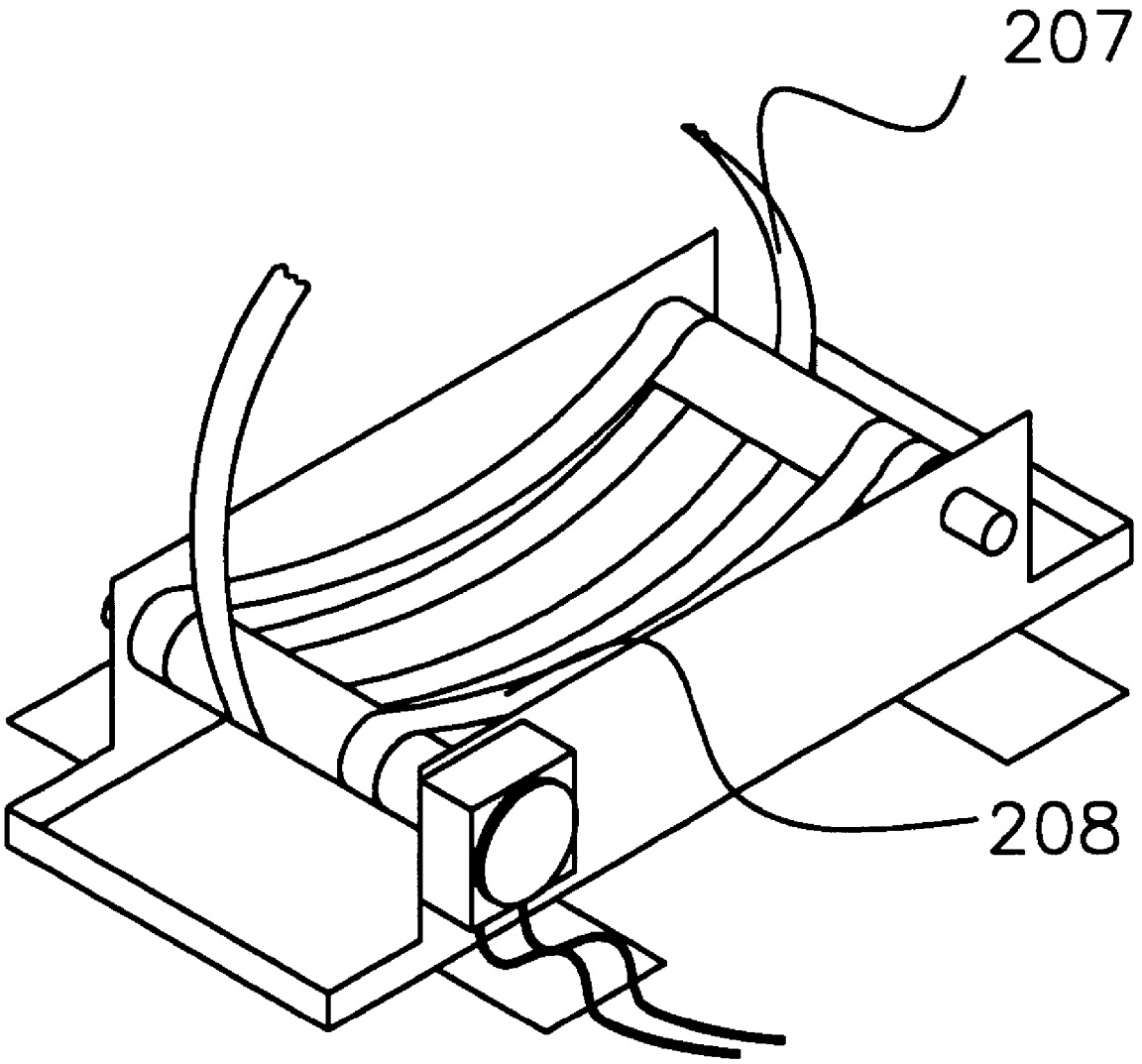
FIG. 5 is an alternate method of driving with a roller drive. The elastic belts in the horizontal drive suspend the drum and add more contact area to insure more power is transmitted to drive the drum. The vertical belt holds the drum onto the roller drive. This type of drive would be good in an automotive or transportation system use where bumps, sudden stops or starts might dislocate or disorient the drum.

FIG. 5 is a modification of the roller drive, in this example flexible bands secure both the bottom and the top of the desiccant drum. This allows the concept to be implemented in a moving, stopping bumping environment for transportation needs where high people density and constant opening and closing of doors allows an abundance of moisture laden outside air to intrude overloading the air-conditioning system.

Figure 6A:
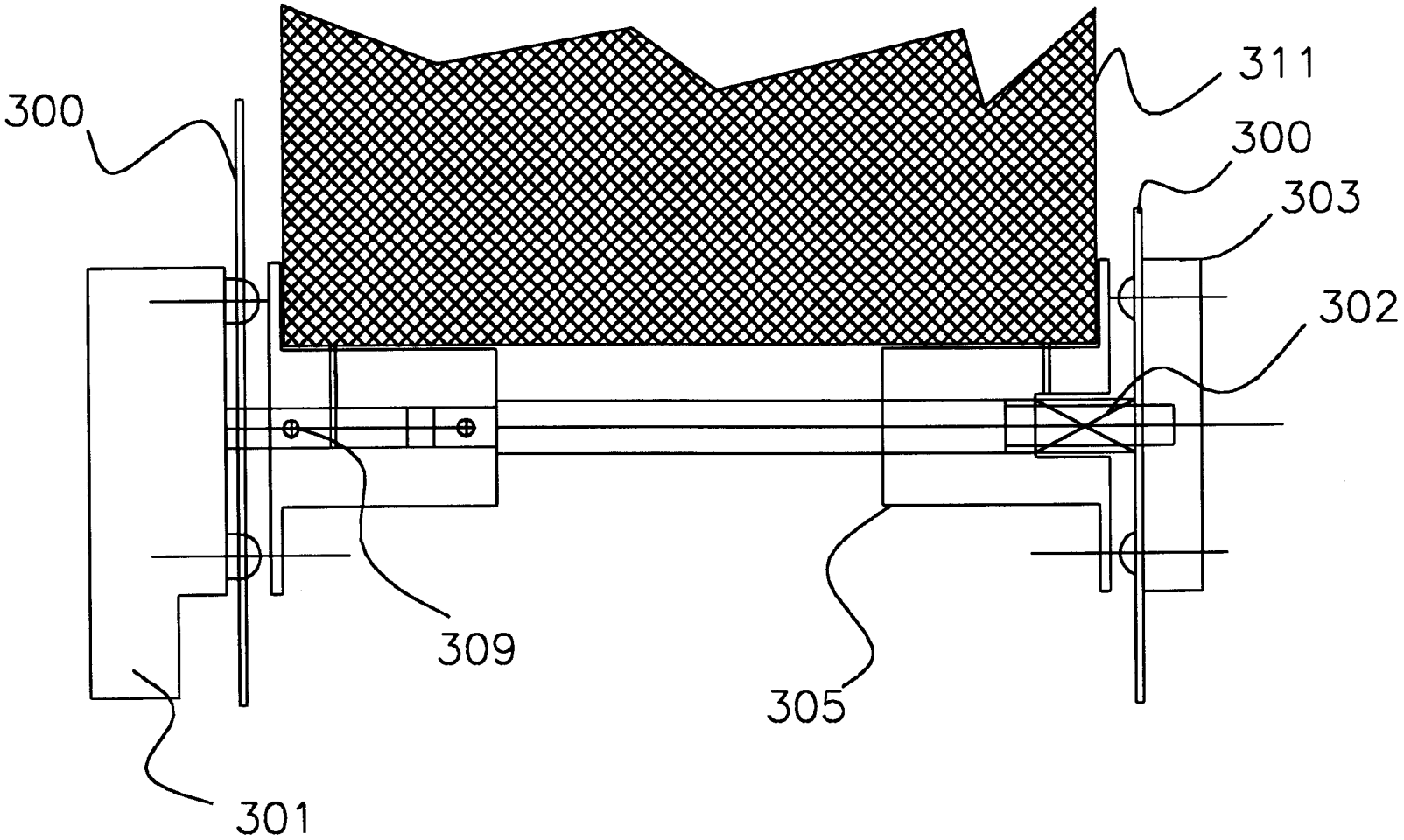
FIG. 6*a* and 6*b* show another version of a drum drive. In this example the drive is spring tensioned against the drum.
Figure 6B:
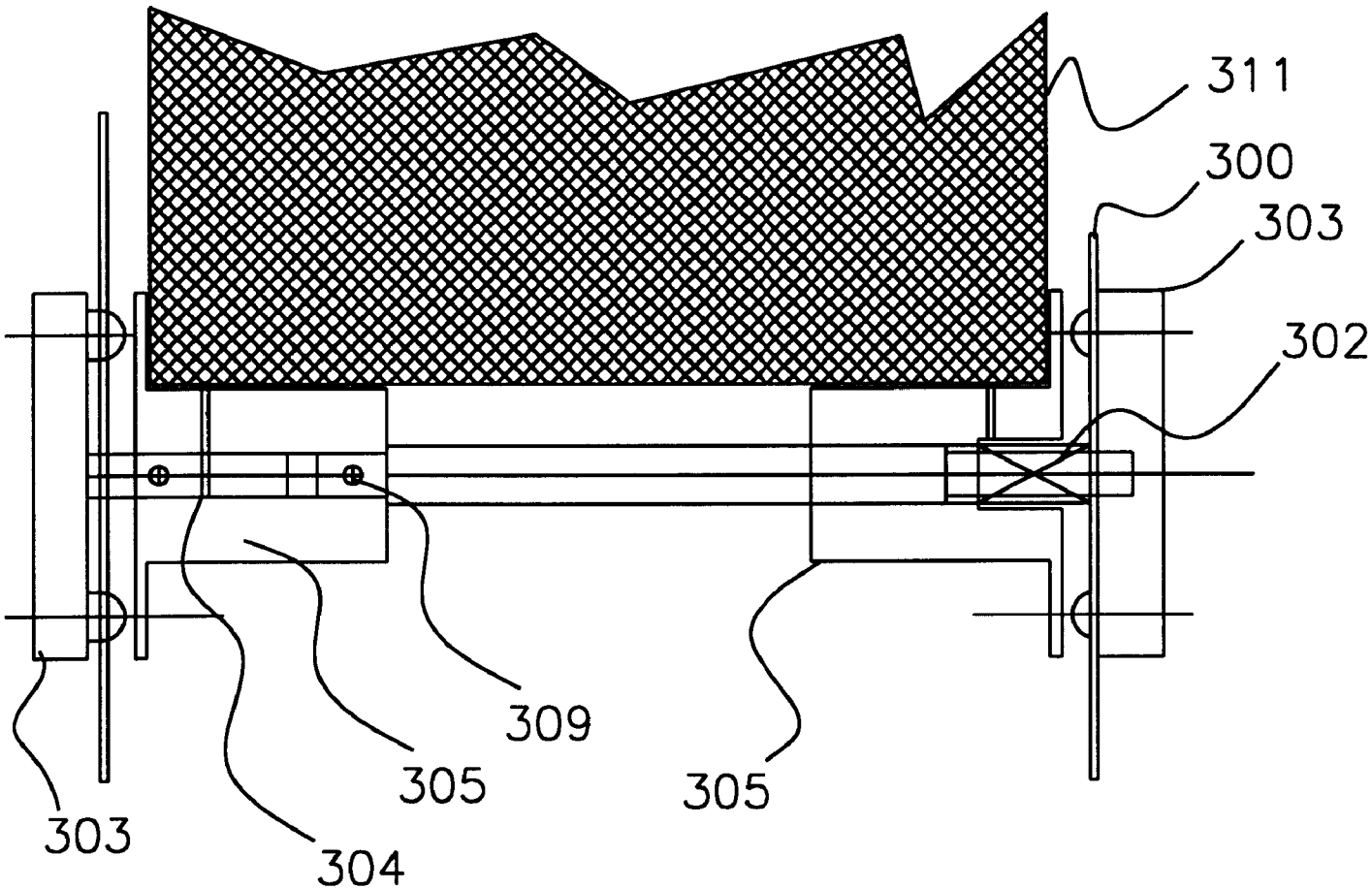

FIG. 6*a* and FIG. 6*b* show another version of a drum drive. The drum is mounted with a rear idler. In this example the drive is spring tensioned against the drum setting a pre-load condition to press the drum against the bulkhead, sealing the wheel while still allowing for rapid access to the wheel.

FIG. 7 is an alternative to the roller drive also allowing ease of removal. The rollers shown could be flanged wheels and an upper idler over the desiccant wheel for transit use.

The foregoing has outlined rather broadly the more pertinent and important features of the present invention in order that the detailed description of the invention that follows may be better understood so that the present contribution to the art can be more fully appreciated. Additionally features of the invention will be described hereinafter which form the subject of the claims of the invention. It should be appreciated by those skilled in the art that the conception and the specific embodiment disclosed may be readily utilized as a basic for modifying or designing other structures for carrying out the same purposes of the present invention. It should also be realized by those skilled in the art that such equivalent constructions do not depart from the spirit and scope of the invention as set forth in the appended claims.

Shown in FIG. 1 for example, is an air "conditioning"/dehumidification assembly in the true sense. Such an air conditioning assembly shown with three parallel flow paths for air being conditioned. The right side or first path is for the receipt of outside air, inside air or a combination thereof. It includes a blower to draw the air into the first path. An optional heat absorber or pre-cooler, since some desiccants are more effective at lower temperatures. It also includes a rotary desiccant or absorbent wheel followed by another optional heat absorber last followed by a heater for use in cooler weather or to better regulate exhaust air temperatures. Thereafter fresh air from the first path is directed into the room or region to be conditioned.

The second center path includes a blower for the exhaust to outside air. This is next followed by a desiccant wheel rotating about an axis parallel with and between the first and second air flow paths. Next following the desiccant wheel are one or more heaters to elevate the temperature causing the wheel to expel or exhaust (give up) the moisture, gasses, and particles. Installing louvers for enclosing the heated section reserves heat when the blower is stopped. Note should be taken that a series of electrical connections and fluid lines connect the heat absorber(s) evaporator(s) of the first path, the compressor or pump of the third path and condenser of the second path adjacent to the blower.

The last also optional adjacent air paths, the third path, takes air and draws it in through the use of a blower. Next following is an compressor, followed usually in outside air conditioners by an evaporator surrounding it. Note must be taken that a system of controls; valves, filters, reservoirs and fluid lines exist between the heat absorber(s), cooling coils of the first path, a compressor with controls in the third path and the evaporator, and heaters of the second path.

In these environments it must be noted that the size, proximity, with and height of the enclosure all have a varying effect on the air volumes and effectiveness of the units in creating more or less of the desired effects. Primarily the temperature differentials and process design requirements suggest selection of a variety of desiccants and other mediums such as: Silica gel, alumina gel, calcium sulfite, zeolites, lithium chloride, triethelene glycol, calcium chloride a deliquescent material (gets wet & dissolves) and even carbon. The function, or intent, of the process design which can be to remove moisture, gasses etc. And especially the operating range that is available as to temperature etc., and naturally the efficiency or output capacity of the unit determines which type of materials or combination is used in the desiccation process.

With reference now to the drawings, and in particular, to FIGS. 1 through 7 thereof, the preferred embodiment of the new and improved cooling assembly embodying the principles and concepts of the present invention and generally designated by the reference number 10 will be described.

Specifically as is shown in FIG. 1 through 3, the unit functions as a separator of two or more air paths and in directing the primary and secondary fluids for absorption in one channel and Desorption in the other. The medium used is one of many desiccant type of materials mentioned earlier.

The first component of FIG. 1 is the arrow symbol 101 which shows the direction of air flow through the air path starting with Path 1. This path is the process or drying path.

102 is a filter of a replaceable type, good filtration is important. Air is guided through the wheel by a wall or bulkhead 104. A blower fan 106 draws process air to the desiccant wheel 108 is a holder for desiccant material which is rotated between the processing and regenerating chambers. The wheel concept could be a set or sets of holders that are alternated or shuttled on a timed or sensor driven sequence between the two paths simulating the turning wheels effectiveness. Path 2 is the regenerative path that drives the moisture from the desiccant, it is more effective if the path is counter to the process flow. Some of the reasons are that if lint and other fibers are allowed to bypass the filter system 102 and 119 the reverse flow removes them. More important since the actual environment temperature and relative humidity changes sometimes drastically, most present systems are build to work in a range of conditions. As this range caused incomplete drying or absorption the wheel is not fully saturated or dried and therefore not operating under optimum conditions. The counter flow allows processed air to lastly leave through the dried side of the wheel guaranteeing some absorption. After passing the filter 119 a wide range of heating methods can be used to assist evaporation or regeneration. These devices if more than one is used should be arranged in the airflow coldest to warmest. If a air-conditioning condenser is in the circuit it should be cautioned that an overabundance of heat might effect the performance of the compressor section. This performance could be monitored by our control. We claim that the use of a that a gas heater using propane or other combustible gas would drive the unit by itself, not shown in this example. A series of induction coils 123 can be installed at the wheel face to cheaply generate a dissipation of moisture. If the wheel is very thick another induction coil 124 can be placed at the wheel. The use of pre-cooling of the wheel reduces the transfer of heat into the regeneration path and saves the energy required to reduce the desiccant temperature to where it effectively absorbs or adsorbs moisture. Moist air is then evacuated through the blower 126 which can be driven by a common motor if the design of the fans compensates for the different flow velocities and volumes required FIG. 4 represents a convenient method of driving the desiccant wheel. It is constructed with a symmetrically constructed one-piece pan 200 for rigidity and alignment housing a specialty integrated drive wheel 202 with grooves 204 using o-rings 205 or a coating to increase friction. The motor 203 and bracket locks into the specially designed stiffener base or is aligned using mounting pads 206. This design further allows the alignment and truing of the desiccant wheel and its instantaneous removal to allow reversal for chemical re-deposition, rejuvenation, storage and replacement. The matching idler 202 aligned by the axles 201 also uses the squared bulkhead assembly as a mounting.

FIG. 5 is a modification of the roller drive, of FIG. 4. In this example, flexible bands secure both the bottom 207 and the top 208 of the desiccant drum. This allows the concept to be installed in a moving, stopping and bumping environment for transportation needs. Naturally, the use of multiple bands will be a natural modification as is the use of one feature without the other or with a top roller or idler for security.

FIGS. 6*a* and 6*b* show another version of a drum drive. The drum is mounted with a front (FIG. 6*a*) and a rear assembly (FIG. 6*b*). In this example, the drive is spring tensioned 302 against the drum 311 and creates a pre-load condition to press the drum against the bulkhead 300 which extends upward on the left of the drawing, thereby sealing the wheel—the seals are not illustrated, while still allowing rapid access to the wheel. The motor 301 acts as a support member on one side and the left side distance is adjustable through the use of a set of screws 309. FIG. 6*b* shows the left side fixed idler 305 that is held by the nut plates 301 that trap the drive axle 304, which allows the movable spring loaded 302, hub 303, to exert a pressure on the wheel 311 against the left sealed bulkhead. It is noted that the idlers could have grooves 306 on which o-rings 307 or some sort of coating is applied. The members could also be molded or machined. An upper idler over the desiccant wheel would secure it for transit use.

FIG. 7 is an alternative of the drum drive. The roller 256 is connected to a drive motor 255, if this assembly is spring-loaded against the wheel 250 and the axle 258 shown as optional is used, the balance of the flanged wheels 257 are not required. However, the flanged wheels 257, will guide the desiccant wheel. An upper idler over the desiccant wheel could secure it for transit use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A system for the dehumidification of cooled air comprising, in combination:

a chamber formed within a rectangular horizontal upper panel, a rectangular horizontal lower panel and two rectangular vertical side panels therebetween and with a rectangular forward panel adjacent to a forward space to receive dehumidified air and a rectangular rearward panel adjacent to a rearward space to receive air to be cooled;

a cylindrical desiccant wheel positioned within the chamber, the desiccant wheel having parallel cylindrical apertures passing axially therethrough with surfaces to remove moisture from cooled air passing therethrough, the desiccant wheel also having an axis of rotation passing through center points of the forward panel and the rearward panel;

a plate vertically positioned through the chamber between the forward panel and the rearward panel and dividing the chamber into a first path and a second path, the plate having a central rectangular aperture for receiving the desiccant wheel therethrough with a first half in the first path and a second half in the second path;

a first roller and a second roller both rotatable about axes parallel with, but offset from, the axis of rotation of the desiccant wheel and mounted upon the lower panel, the first roller being located in the first path and including a drive motor for driving the first roller and with the second roller being located in the second path, the desiccant wheel resting upon the rollers for rotation upon rotation of the first roller by the drive roller to sequentially bring the cylindrical apertures of the desiccant wheel through the first path of the chamber for the dehumidification of cooled air passing therethrough and then through the second path of the chamber for the removal of moisture from the cylindrical apertures of the desiccant wheel by the passage therethrough of air to be cooled in a continuous cycle of operation;

a large input opening on the rearward panel at the input end of the first path and a small output opening covered by an air filter in the forward panel at the output end of the first path with a squirrel cage motor adjacent to the output opening for the drawing of air through the first path and one half of the desiccant wheel to the forward space; and a large input opening in the forward panel at the input end of the second path and a small output opening covered with an air filer in the rearward panel at the output end of the second path with a squirrel cage motor located adjacent to the output of the second path for the drawing of air through the second path and one half of the desiccant wheel with a plurality of heating coils in the second path between the large input opening and the desiccant wheel for heating air prior to passing through the desiccant wheel for the removal of moisture therefrom.

2. A system for the dehumidification of cooled air comprising, in combination:

a chamber with a forward end adjacent to a forward space to receive dehumidified air and a rearward end adjacent to a rearward space to receive air to be cooled;

a cylindrical desiccant wheel positioned within the chamber, the desiccant wheel having parallel cylindrical apertures passing axially therethrough with surfaces to remove moisture from cooled air passing therethrough, the desiccant wheel also having an axis of rotation;

a plate positioned through the chamber and dividing the chamber into a first path and a second path with the desiccant wheel having a first half in the first path and a second half in the second path;

rollers rotatable about axes parallel with, but offset from, the axis of rotation of the desiccant wheel and mounted with respect to a lower panel of the chamber, at least one roller being located in the first path and at least one roller being located in the second path, the desiccant wheel resting upon the rollers for rotation therewith and a driver to sequentially bring the cylindrical apertures of the desiccant wheel through the first path of the chamber for the dehumidification of cooled air passing therethrough and then through the second path of the chamber for the removal of moisture from the cylindrical apertures of the desiccant wheel by the passage therethrough of air to be cooled in a continuous cycle of operation;

an input opening in the rearward end at the input end of the first path and an output opening in the forward end at the output end of the first path, the input opening in the rearward end at the input end of the first path and the output opening in the forward end at the output end of the first path being disposed above the chamber;

an input opening in the forward end at the input end of the second path and an output opening in the rearward end at the output end of the second path with a plurality of heating coils in the second path between the input opening and the desiccant wheel, the input opening in the forward end at the input end of the second path and the output opening in the rearward end at the output end of the second path being disposed above the chamber; and a one-piece pan that is secured to the lower panel for rotatably securing the rollers, said rollers including a drive roller with associated motor disposed within the first path and an idle roller disposed within the second path.

3. A system for the dehumidification of cooled air comprising, in combination:

a chamber with a forward end adjacent to a forward space to receive dehumidified air and a rearward end adjacent to a rearward space to receive air to be cooled;

a cylindrical desiccant wheel positioned within the chamber, the desiccant wheel having parallel cylindrical apertures passing axially therethrough with surfaces to remove moisture from cooled air passing therethrough, the desiccant wheel also having an axis of rotation;

a plate positioned through the chamber and dividing the chamber into a first path and a second path with the desiccant wheel having a first half in the first path and a second half in the second path;

rollers rotatable about axes parallel with, but offset from, the axis of rotation of the desiccant wheel and mounted with respect to a lower panel of the chamber, at least one roller being located in the first path and at least one roller being located in the second path, the desiccant wheel resting upon the rollers for rotation therewith and a driver to sequentially bring the cylindrical apertures of the desiccant wheel through the first path of the chamber for the dehumidification of cooled air passing therethrough and then through the second path of the chamber for the removal of moisture from the cylindrical apertures of the desiccant wheel by the passage therethrough of air to be cooled in a continuous cycle of operation;

an input opening in the rearward end at the input end of the first path and an output opening in the forward end at the output end of the first path, the input opening in the rearward end at the input end of the first path and the output opening in the forward end at the output end of the first path being disposed above the chamber;

an input opening in the forward end at the input end of the second path and an output opening in the rearward end at the output end of the second path with a plurality of heating coils in the second path between the input opening and the desiccant wheel, the input opening in the forward end at the input end of the second path and the output opening in the rearward end at the output end of the second path being disposed above the chamber;

a one-piece pan that is secured to the lower panel for rotatably securing the rollers, said rollers including a drive roller with associated motor disposed within the first path and an idle roller disposed within the second path; and the rollers further including a band extending therebetween and over the desiccant wheel.

4. The system according to claim 2, wherein one of the rollers is spring-tensioned against the desiccant wheel.

5. The system according to claim 3, wherein one of the rollers is spring-tensioned against the desiccant wheel.

6. A system for the dehumidification of cooled air comprising, in combination:

a chamber with a forward end adjacent to a forward space to receive dehumidified air and a rearward end adjacent to a rearward space to receive air to be cooled;

a cylindrical desiccant wheel positioned within the chamber, the desiccant wheel having parallel cylindrical apertures passing axially therethrough with surfaces to remove moisture from cooled air passing therethrough, the desiccant wheel also having an axis of rotation;

a plate positioned through the chamber and dividing the chamber into a first path and a second path with the desiccant wheel having a first half in the first path and a second half in the second path;

rollers rotatable about axes parallel with, but offset from, the axis of rotation of the desiccant wheel and mounted with respect to a lower panel of the chamber, at least one roller being located in the first path and at least one roller being located in the second path, the desiccant wheel resting upon the rollers for rotation therewith and a driver to sequentially bring the cylindrical apertures of the desiccant wheel through the first path of the chamber for the dehumidification of cooled air passing therethrough and then through the second path of the chamber for the removal of moisture from the cylindrical apertures of the desiccant wheel by the passage therethrough of air to be cooled in a continuous cycle of operation;

an input opening in the rearward end at the input end of the first path and an output opening in the forward end at the output end of the first path, the input opening in the rearward end at the input end of the first path and the output opening in the forward end at the output end of the first path being disposed above the chamber;

an input opening in the forward end at the input end of the second path and an output opening in the rearward end at the output end of the second path with a plurality of heating coils in the second path between the input opening and the desiccant wheel, the input opening in the forward end at the input end of the second path and the output opening in the rearward end at the output end of the second path being disposed above the chamber;

a one-piece pan that is secured to the lower panel for rotatably securing the rollers, said rollers including a drive roller with associated motor disposed within the first path and an idle roller disposed within the second path;

the rollers further including a band extending therebetween and over the desiccant wheel;

one of the rollers being spring-tensioned against the desiccant wheel;

a pair of flanged wheels included with each of the rollers, the flanged wheels receiving the desiccant wheel therebetween; and a spring-tensioned belt included with the rollers and drive roller, the spring-tensioned belt extending around the desiccant wheel.

* * * * *